US006554284B2

(12) United States Patent
Chou

(10) Patent No.: US 6,554,284 B2
(45) Date of Patent: Apr. 29, 2003

(54) TARGET ASSEMBLY FOR PRACTICING BALL GAMES

(76) Inventor: Jason Chou, No. 354, Sec. 2, Yon Pin Road, Taiping City, Taichung Hsien (TW), 411

( * ) Notice: Subject to any disclaimer, the term of this patent is extended or adjusted under 35 U.S.C. 154(b) by 0 days.

(21) Appl. No.: 10/134,002

(22) Filed: Apr. 29, 2002

(65) Prior Publication Data

US 2002/0109301 A1 Aug. 15, 2002

Related U.S. Application Data

(63) Continuation-in-part of application No. 09/634,811, filed on Aug. 8, 2000, now abandoned.

(51) Int. Cl.[7] ..... F41J 5/04

(52) U.S. Cl. ..... 273/371; 273/373; 473/173; 473/190; 473/192; 473/451; 473/455

(58) Field of Search ..... 473/173, 190, 473/192, 451, 454, 455, 476; 273/348, 371, 373, 374, 377, 378

(56) References Cited

U.S. PATENT DOCUMENTS 3,469,843 A * 9/1969 Hubbard ..... 273/373
3,508,752 A 4/1970 Lemon
4,006,907 A * 2/1977 Heffley, Jr. ..... 473/192
4,511,146 A * 4/1985 Windall ..... 473/192
5,820,496 A * 10/1998 Bergeron ..... 473/455
6,089,571 A 7/2000 Cho
6,155,570 A * 12/2000 Allison et al. ..... 273/373
6,215,390 B1 * 4/2001 Brown ..... 340/323 R
6,247,700 B1 * 6/2001 Procupetz ..... 273/408

* cited by examiner

*Primary Examiner*—Raleigh W. Chiu
(74) *Attorney, Agent, or Firm*—Charles E. Baxley

(57) ABSTRACT

A target device includes a rear sheet member and a front sheet member each having one or more conductor members aligned with each other, and an intermediate member disposed between the sheet members for separating the conductor members from each other. The intermediate member is compressible or deformable, or includes one or more openings having an area large enough for allowing the conductor members to be contacted with each other when the sheet members are deformed and hit by balls. The target device may be supported in any place or position with a frame.

11 Claims, 8 Drawing Sheets

TARGET ASSEMBLY FOR PRACTICING BALL GAMES

The present invention is a continuation-in-part of U.S. patent application Ser. No. 09/634,811, filed on Aug. 8, 2000, now abandoned.

BACKGROUND OF THE INVENTION

1. Field of the Invention

The present invention relates to a target assembly, and more particularly to a target assembly for practicing ball games, such as for practicing the striking of the golf balls, or the throwing or the batting of the base balls, or the striking of the hockey balls, etc.

2. Description of the Prior Art

Typical target devices, such as the dart boards, may be used for practicing the dart games. For example, U.S. Pat. No. 3,508,752 to Lemon discloses one of the typical dart games having a target to be hit by the darts. However, the target may be damaged when the target is hit by base balls or golf balls.

U.S. Pat. No. 6,089,571 to Cho discloses the other typical dart game including a number of dart or target segments to be hit by the darts. The target segments each includes one or more legs for engaging with the switch points of two conductor sheets. However, the conductor sheets may be punctured or broken by the legs, such that the target may be damaged when the target is hit by base balls or golf balls. The conventional target devices may not be used for practicing the other ball games, such as for practicing the striking of the golf balls, or the throwing or the batting of the base balls, or the striking of the hockey balls, etc. The conventional target devices may be easily damaged by the base balls, the golf balls, and the hockey balls.

The present invention has arisen to mitigate and/or obviate the afore-described disadvantages of the conventional target devices.

SUMMARY OF THE INVENTION

The primary objective of the present invention is to provide a target assembly for practicing ball games, such as for practicing the striking of the golf balls, or the throwing or the batting of the base balls, or the striking of the hockey balls, etc.

In accordance with one aspect of the invention, there is provided a target assembly comprising a first sheet member including at least one first conductor member provided thereon, a second sheet member disposed in front of the first sheet member, and including at least one second conductor member provided thereon and aligned with the first conductor member, the second sheet member being flexible and deformable, and an intermediate member disposed between the first sheet member and the second sheet member for separating the first conductor member and the second conductor member from each other. The intermediate member is compressible or deformable, or includes at least one opening formed therein and having an area large enough for allowing the first conductor member and the second conductor member to be contacted with each other when the second sheet member is deformed and hit by a ball.

The intermediate member is preferably a net member formed with ropes. The ropes are preferably compressible and deformable for facilitating a contacting of the first conductor member with the second conductor member.

A front member is further provided and disposed in front of the second sheet member, and includes at least one target area aligned with the first conductor member and the second conductor member of the first and the second sheet members.

A displaying device may further be provided for displaying a contacting of the first conductor member with the second conductor member and includes at least one light device, and means for detecting the contacting of the first conductor member with the second conductor member.

The displaying device includes a casing for receiving the light device, and a coupler coupled to the light device.

A frame is further provided, and a device is further provided for securing the first and the second sheet members and the intermediate member to the frame and includes at least one eyelet secured to the first and the second sheet members and the intermediate member, and at least one cable includes a first end engaged with the eyelet, and a second end engaged with the frame.

The frame includes a parallelepiped structure for allowing the frame to be disposed on any places, such as disposed in home, or in the back yards.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
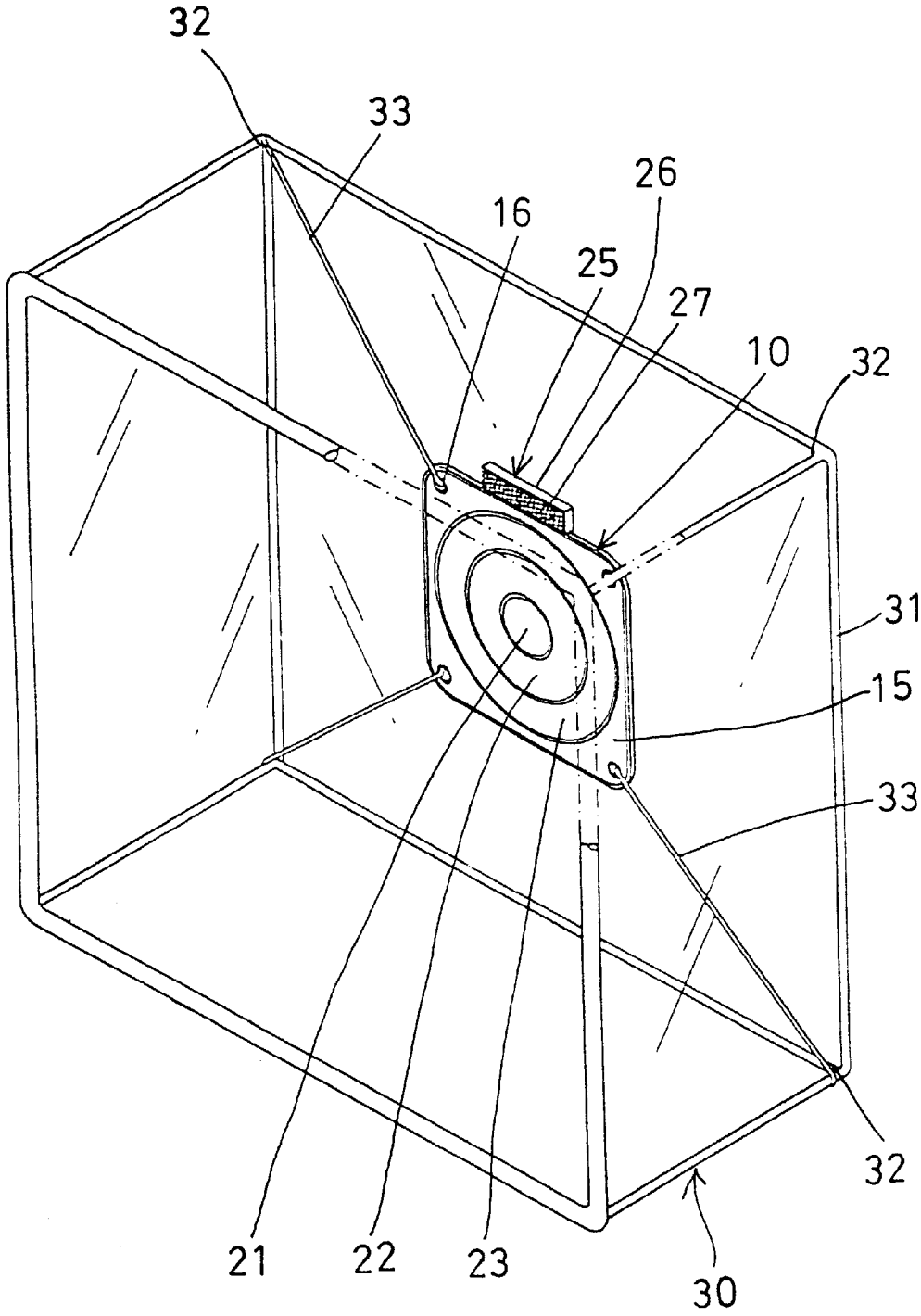
FIG. 1 is a perspective view of a target assembly in accordance with the present invention.
Figure 2:
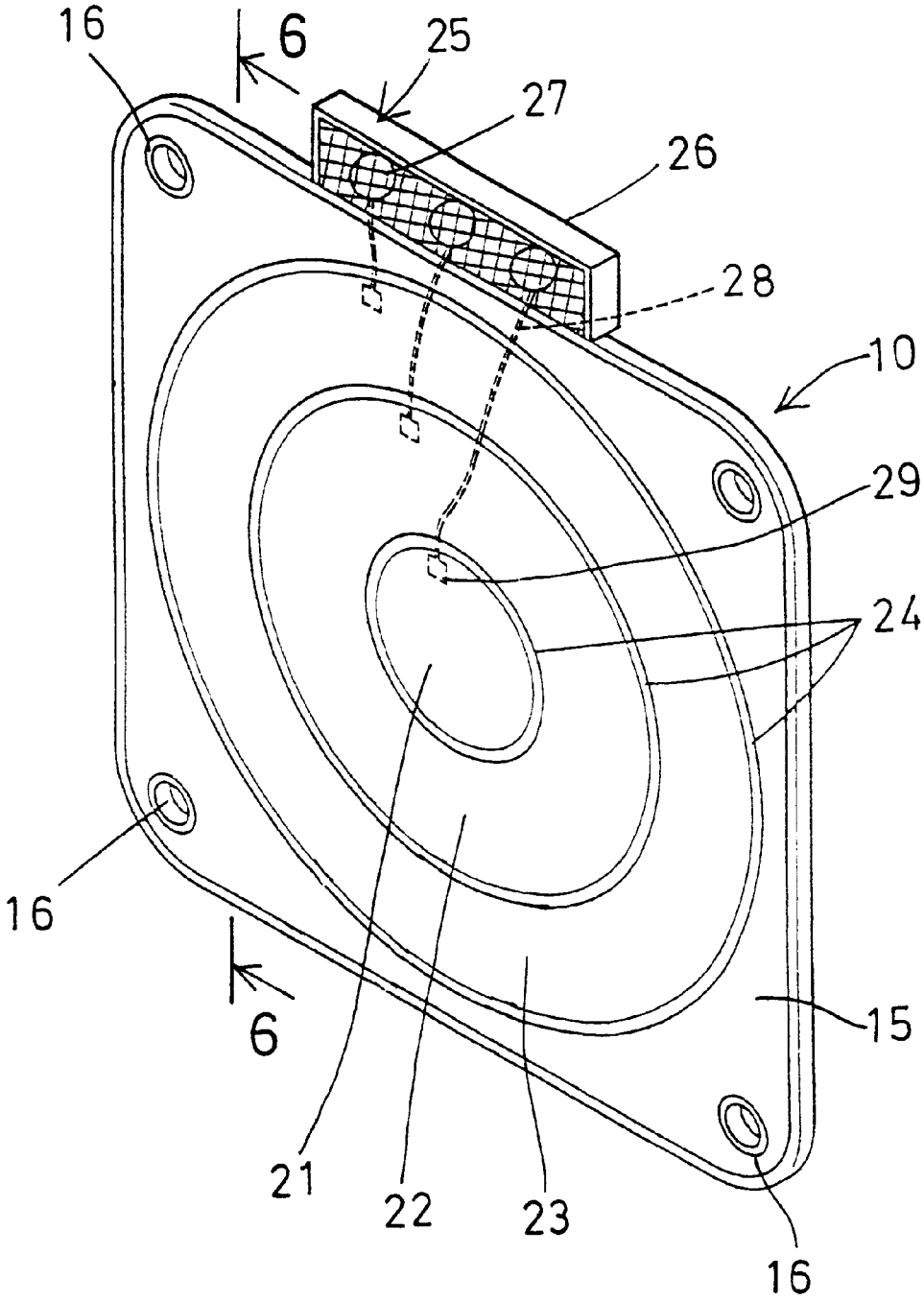
FIG. 2 is a perspective view of a target device of the target assembly.
Figure 3:
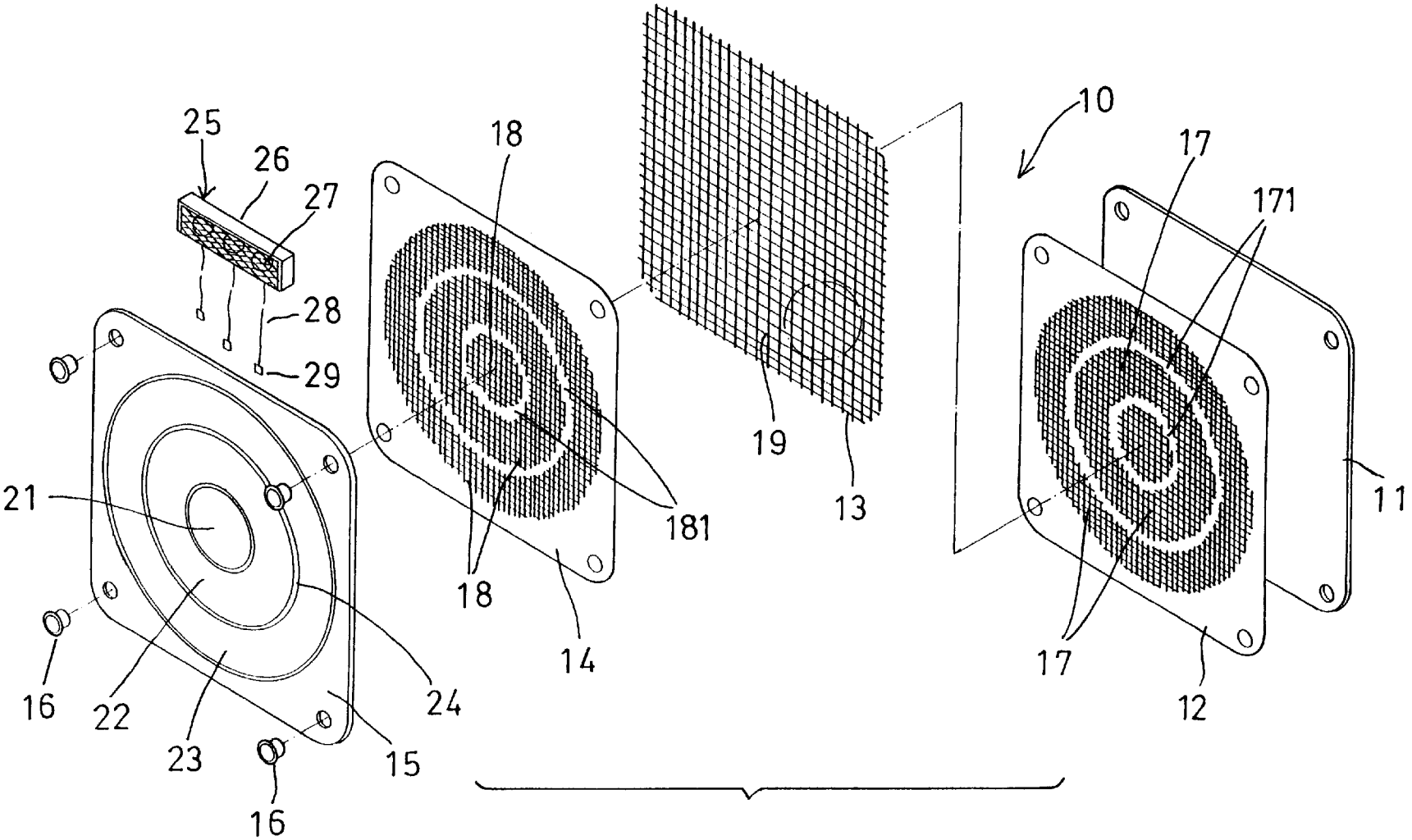
FIG. 3 is an exploded view of the target device.

Referring to the drawings, and initially to FIGS. 1–3, a target assembly in accordance with the present invention comprises a target device 10 including a base member 11, a rear and a front sheet members 12, 14 disposed in front of the base member 11, an intermediate member 13 disposed between the rear and the front sheet members 12, 14, and a front member 15 disposed in front of the sheet members 12, 14. One or more eyelets 16 are engaged through, such as engaged through the corners of the base member 11 and the sheet members 12, 14, and the intermediate member 13, and the front member 15, for securing the members 11–15 together.

The sheet members 12, 14 each includes one or more conductors, or circuits, such as the printed circuits 17, 18 provided or applied thereon, which are divided into one or more target areas, such as the concentric target areas as shown in FIG. 3, and aligned with each other. The target areas of the sheet members 12, 14 may also be formed into various kinds of shapes. The sheet members 12, 14, particularly the front sheet member 14, may be made or formed as the flexible membranes, or may be made of plastic or rubber or the other flexible materials, for allowing the sheet members 12, 14 to be compressed and deformed and for allowing the printed circuits 17, 18 to be contacted with each other when the sheet members 12, 14 are hit or stricken by a ball 70, 71, best shown in FIG. 7.

As shown in FIGS. 3–6, the intermediate member 13 is preferably a net member, and formed by a number of horizontal or vertical or intersecting or woven ropes 19, and includes a number of openings 20 formed in the net member or formed between the ropes 19. The intermediate member 13 is disposed between the sheet members 12, 14, for separating the printed circuits 17, 18 from each other, and for preventing the printed circuits 17, 18 from being contacted with each other before the sheet members 12, 14 are hit or stricken by the ball 70, 71.

Figure 5:
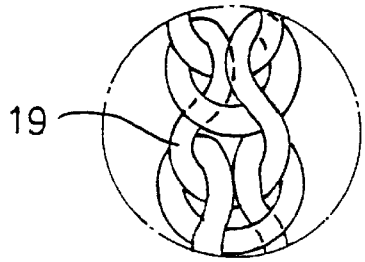
FIG. 5 is a further enlarged partial perspective view of the intermediate member of the target device.
Figure 4:
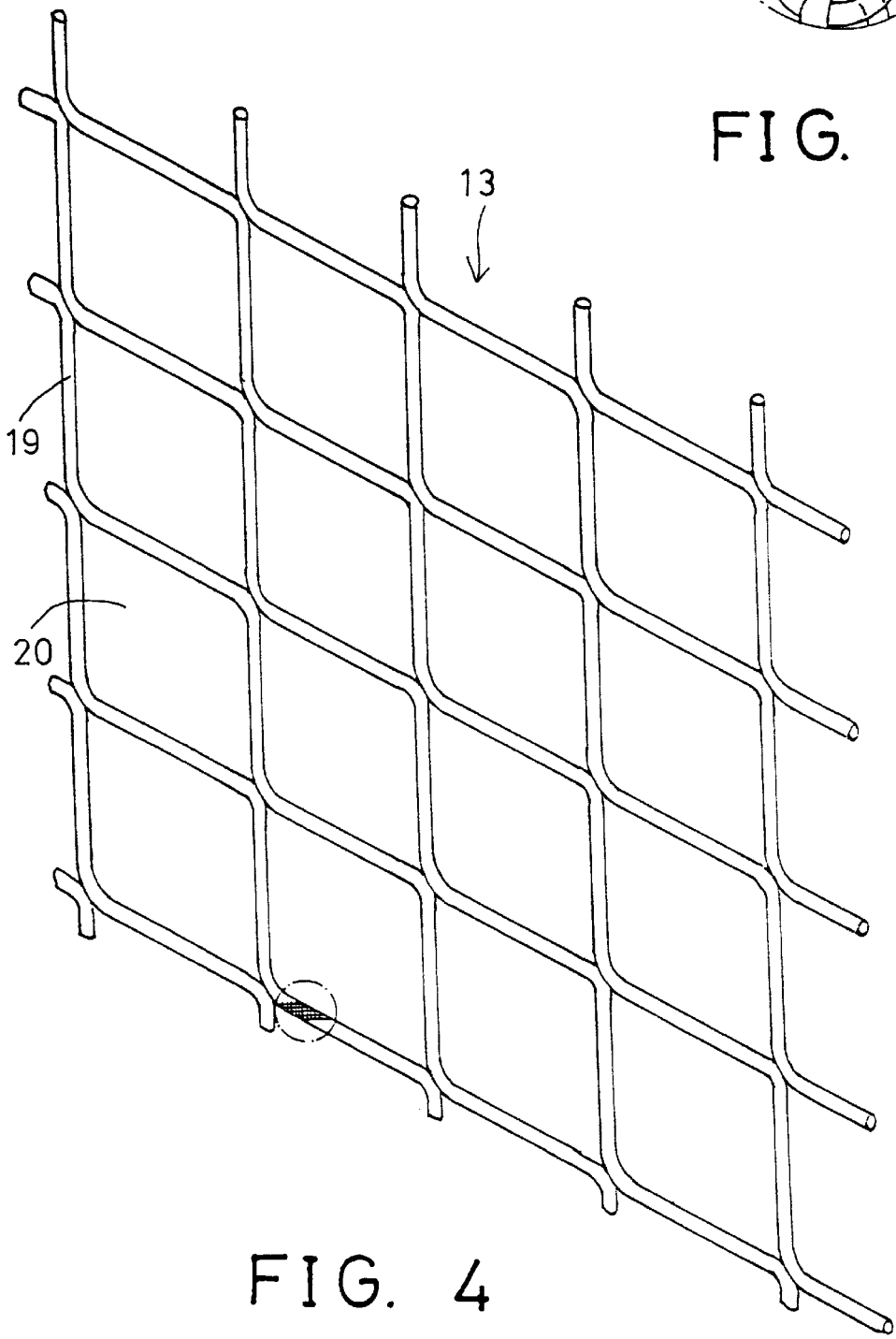
FIG. 4 is an enlarged partial perspective view of an intermediate member of the target device.
Figure 6:
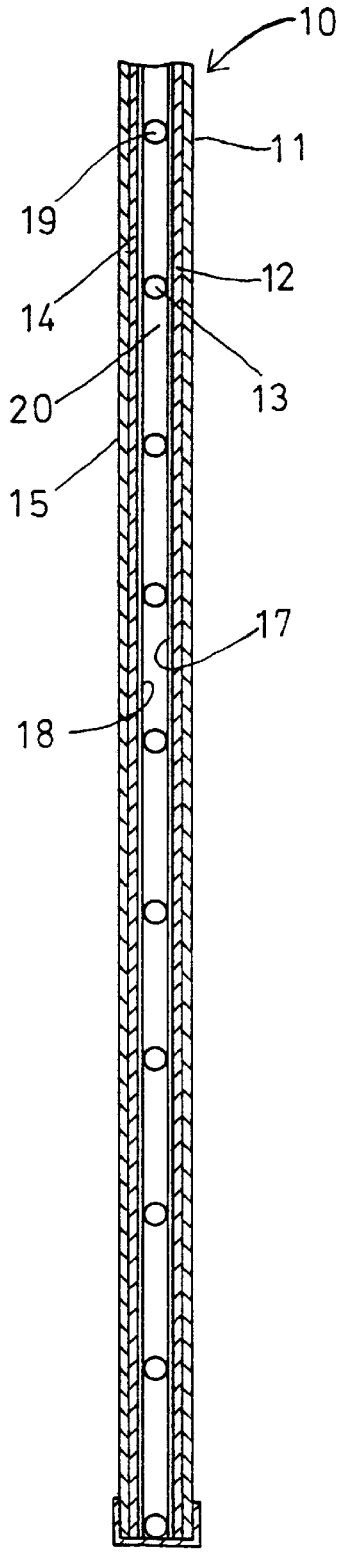
FIG. 6 is a partial cross sectional view taken along lines 6—6 of FIG. 2.
Figure 7:
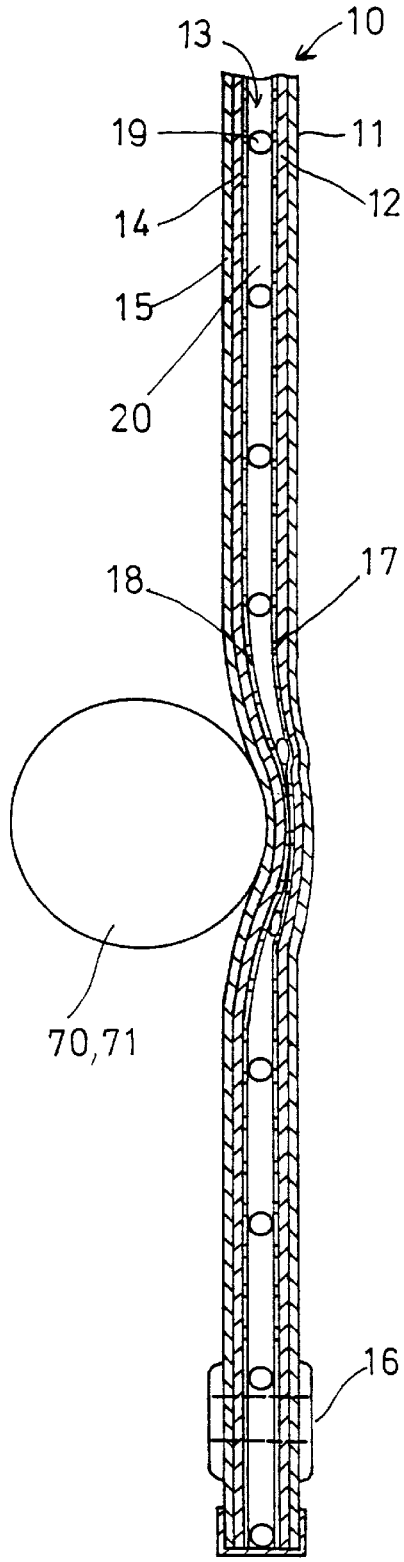
FIG. 7 is a partial cross sectional view similar to FIG. 6, illustrating the operation of the target device.

The openings 20 of the intermediate member 13 include an area large enough for allowing the printed circuits 17, 18 to be contacted with each other, when the sheet members 12, 14 are compressed and deformed, and when the sheet members 12, 14 are hit or stricken by the ball 70, 71, best shown in FIG. 7. As shown in FIGS. 5 and 7, the ropes 19 themselves include a compressible or deformable structure, for further facilitating the contacting of the printed circuits 17, 18 with each other when the sheet members 12, 14 are compressed and deformed or hit or stricken by the ball 70, 71.

As shown in FIGS. 1–3. the front member 15 is also preferably made of flexible materials, and includes one or more target areas 21, 22, 23, such as the concentric target areas. Similarly, the target areas of the sheet members 12, 14 may also be formed into various kinds of shapes, corresponding to that of the printed circuits 17, 18 of the sheet members 12, 14. One or more marginal lines, such as the concentric marginal lines 24 may further be provided and disposed between the target areas 21, 22, 23, for allowing the users to see or to identify the target areas 21, 22, 23. The target areas of the printed circuits 17, 18 are also separated from each other by marginal lines 171, 181.

A displayer device 25 may further be provided, and includes a casing 26 disposed on such as the target device 10, but may also be disposed on the other places or positions. One or more light devices 27, such as the light bulbs, or the liquid crystal displayers, or the light emitting diodes 27 are disposed in the casing 26, and electrically coupled to the printed circuits 17, 18 with electric wires 28 and sensors or detectors or switches or couplers 29, corresponding to the target areas 21, 22, 23 respectively.

Figure 8:
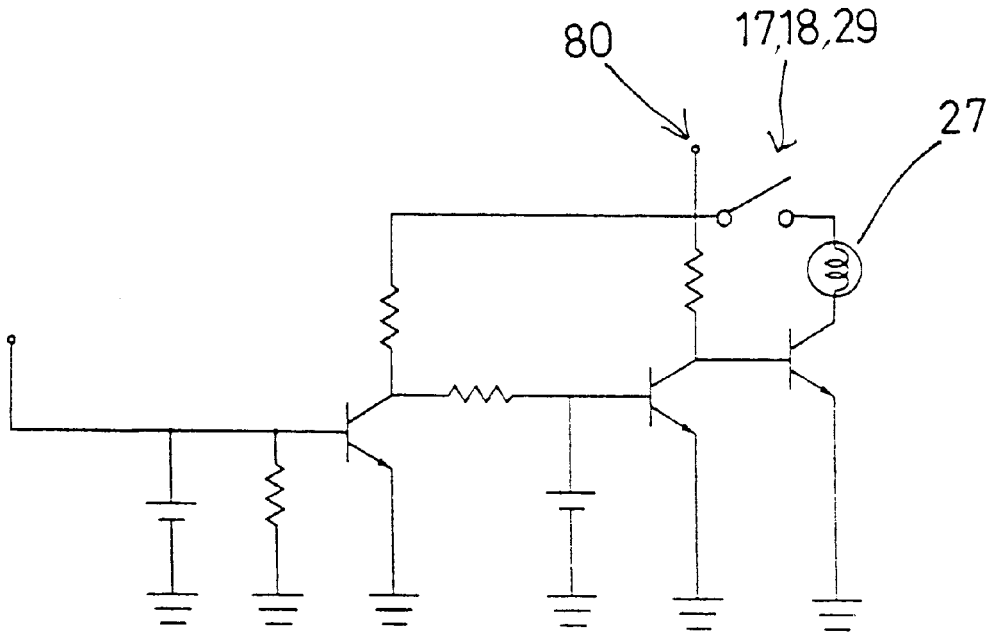
FIG. 8 is a diagram illustrating the electric circuit of the target device.

Referring next to FIG. 8, the light devices 27 may be coupled to an electric power supply 80 via the printed circuits 17, 18 and the couplers 29. For example, when the printed circuits 17, 18 are caused to be contacted with each other, the switches or the couplers 29 may be switched on, or may be actuated to energize the light devices 27 in order to show or to display that the corresponding target areas 21, 22, 23 have been hit or stricken by the ball 70, 71. The couplers 29 may thus be used to detect whether the printed circuits 17, 18 have been contacted with each other or not.

In operation, as shown in FIGS. 2 and 7, when the target device 10 is hit or stricken by a ball 70, 71, the light devices 27 of the corresponding target areas 21, 22, 23 of the target device 10 may be caused to be energized when the corresponding target areas 21, 22, 23 have been hit or stricken by the ball 70, 71. The sheet member 14 and the front member 15 and the intermediate member 13, and/or the sheet member 12 and the base member 11 are made of flexible materials, or are made or formed into the flexible membranes, for allowing the sheet members 12, 14 to be compressed and deformed, and for allowing the printed circuits 17, 18 to be contacted with each other.

Referring next to FIGS. 9 and 10, and again to FIG. 1, the target assembly further includes a support or a frame 30 for supporting the target device 10. For example, the frame 30 includes a substantially parallelepiped structure for allowing the frame 30 to be moved to any suitable position. The frame 30 includes a rear portion 31 having such as four corner areas 32. One or more, such as four cables 33 each includes one end engaged through the eyelets 16, and the other end secured to the corner areas 32 of the frame 30, for hanging the target device 10 in the middle or center of the rear portion 31 of the frame 30.

Figure 9:
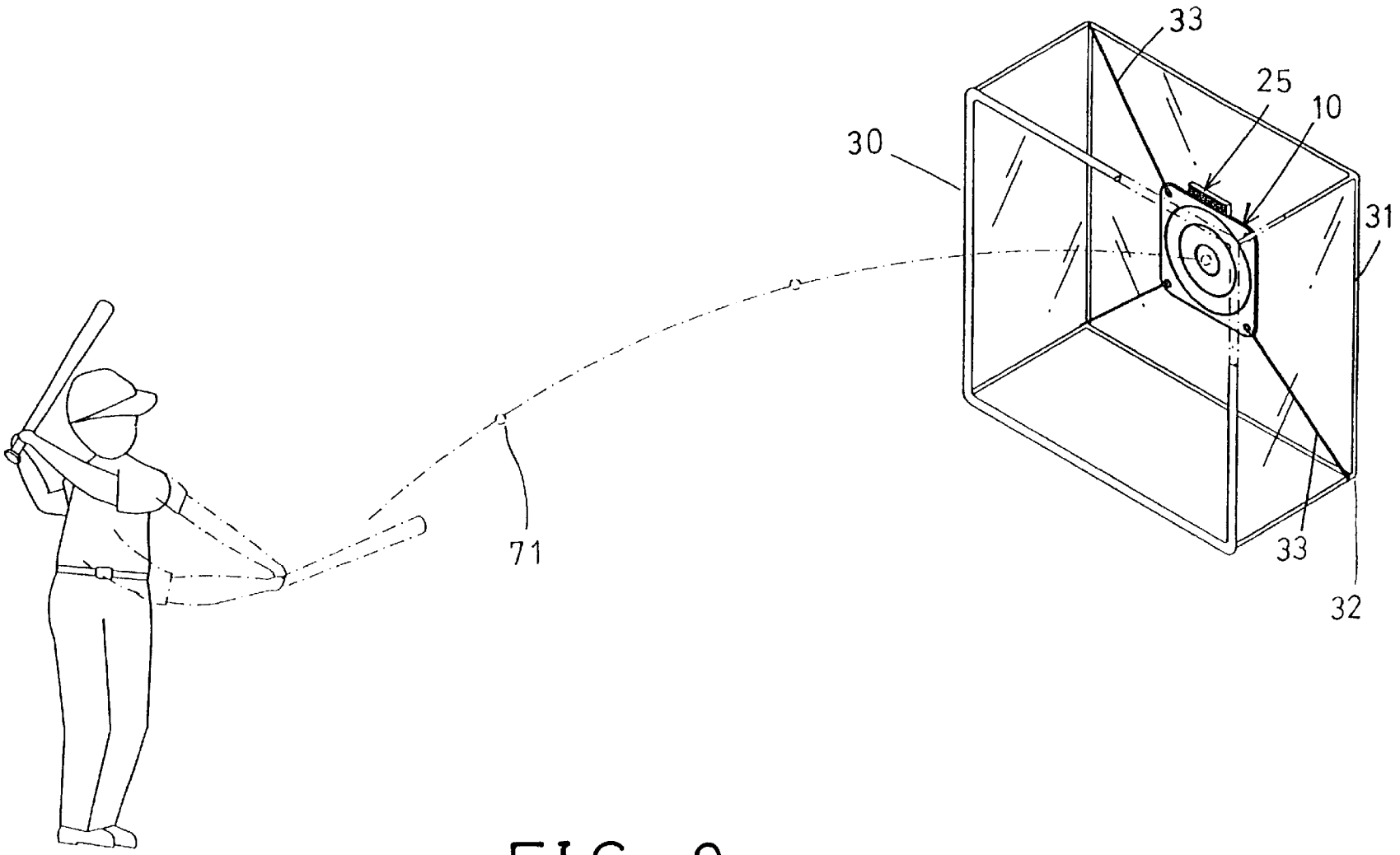
FIGS. 9 and 10 are perspective views illustrating the operation of the target assembly.
Figure 10:
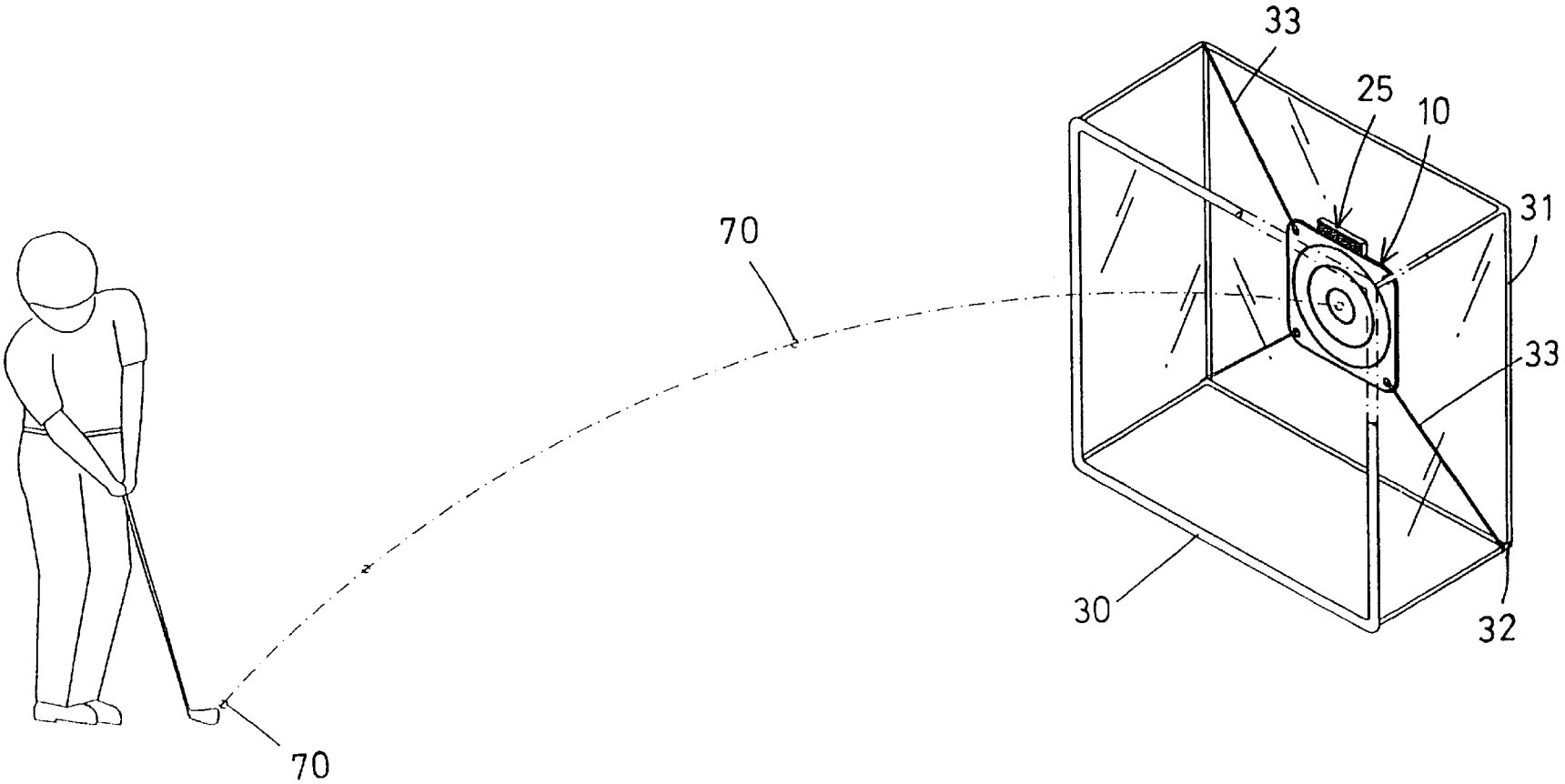

As shown in FIGS. 9 and 10, the frame 30 and the target device 10 may be disposed in any suitable positions in the homes or in the back yards, for allowing the users to practice ball games at home, such as to practice the striking of the golf balls 70 (FIG. 10), or the throwing or the batting of the base balls 71, or the striking of the hockey balls, etc. The displayer device 25 may be used to show whether the ball 70, 71 has been stricken or hit onto the aimed target areas 21, 22, 23 or not. For safety purposes, the displayer device 25 may be disposed on or behind the frame 30 for preventing the displayer device 25 from being hit by the ball 70, 71. Alternatively, the displayer device 25 may also be disposed closer to the users for allowing the users to clear see the scores or the light devices 27 of the displayer device 25.

Accordingly, the target assembly in accordance with the present invention may be used for practicing ball games, such as for practicing the striking of the golf balls, or the throwing or the batting of the base balls, or the striking of the hockey balls, etc.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A target assembly comprising:

a first sheet member including at least one first conductor member provided thereon, a second sheet member disposed in front of said first sheet member, and including at least one second conductor member provided thereon and aligned with said at least one first conductor member, said second sheet member being flexible and deformable, an intermediate member disposed between said first sheet member and said second sheet member for separating said at least one first conductor member and said at least one second conductor member from each other, said intermediate member including at least one opening formed therein and having an area large enough for allowing said at least one first conductor member and said at least one second conductor member to be contacted with each other when said second sheet member is deformed and hit by a ball.

2. The target assembly according to claim 1, wherein said intermediate member is a net member formed with ropes.

3. The target assembly according to claim 2, wherein said ropes are compressible and deformable for facilitating a contacting of said at least one first conductor member with said at least one second conductor member.

4. The target assembly according to claim 1 further comprising a front member disposed in front of said second sheet member, and including at least one target area aligned with said at least one first conductor member and said at least one second conductor member of said first and said second sheet members.

5. The target assembly according to claim 1 further comprising means for displaying a contacting of said at least one first conductor member with said at least one second conductor member.

6. The target assembly according to claim 5, wherein said displaying means includes at least one light device, and means for detecting the contacting of said at least one first conductor member with said at least one second conductor member.

7. The target assembly according to claim 6, wherein said displaying means includes a casing for receiving said at least one light device, and the detecting means includes a coupler coupled to said at least one light device.

8. The target assembly according to claim 1 further comprising a frame, and means for securing said first and said second sheet members and said intermediate member to said frame.

9. The target assembly according to claim 8, wherein said securing means includes at least one eyelet secured to said first and said second sheet members and said intermediate member, and at least one cable includes a first end engaged with said at least one eyelet, and a second end engaged with said frame.

10. The target assembly according to claim 8, wherein said frame includes a parallelepiped structure for allowing said frame to be disposed on any places.

11. A target assembly comprising:

a first sheet member including at least one first conductor member provided thereon, a second sheet member disposed in front of said first sheet member, and including at least one second conductor member provided thereon and aligned with said at least one first conductor member, said second sheet member being flexible and deformable, an intermediate member disposed between said first sheet member and said second sheet member for separating said at least one first conductor member and said at least one second conductor member from each other, said intermediate member being compressible and deformable for allowing said at least one first conductor member and said at least one second conductor member to be contacted with each other when said second sheet member is deformed and hit by a ball.

* * * * *